US005878684A

United States Patent [19]

Adams

[11] Patent Number: 5,878,684

[45] Date of Patent: Mar. 9, 1999

[54] CLEATING DEVICE

[76] Inventor: Mark J. Adams, P.O. Box 11278, Bainbridge Island, Wash. 98110

[21] Appl. No.: 910,644

[22] Filed: Aug. 13, 1997

[51] Int. Cl.[6] ..... B63B 21/04

[52] U.S. Cl. ..... 114/218; D8/356

[58] Field of Search ..... 114/218; D8/356

[56] References Cited

U.S. PATENT DOCUMENTS

| | | |
|---|---|---|
| D. 29,330 | 9/1898 | Gaskill . |
| 78,964 | 6/1868 | Haskins . |
| D. 179,328 | 11/1956 | Stewart . |
| D. 186,906 | 12/1959 | Behuk et al. . |
| D. 187,197 | 2/1960 | Sanger et al. . |
| D. 191,885 | 12/1961 | Corlett . |
| D. 215,405 | 9/1969 | Patmaude . |
| D. 216,222 | 12/1969 | Magi et al. . |
| D. 219,574 | 12/1970 | Cahen . |
| D. 227,216 | 6/1973 | Miller . |
| D. 227,217 | 6/1973 | Pick . |
| D. 239,258 | 3/1976 | Faul . |
| D. 255,419 | 6/1980 | Hume . |
| D. 299,311 | 1/1989 | Whitley, III . |
| D. 300,721 | 4/1989 | Whitley, II . |
| D. 301,683 | 6/1989 | Whitley, II . |
| 517,597 | 4/1894 | Twitty . |
| 533,603 | 2/1895 | McEvoy . |
| 557,984 | 4/1896 | Foran . |
| 1,291,341 | 1/1919 | Young . |
| 1,691,412 | 11/1928 | Ruetz et al. . |
| 1,694,312 | 12/1928 | Clark . |
| 1,770,967 | 7/1930 | Bean . |
| 2,011,532 | 8/1935 | Wanser, Sr. . |
| 2,098,238 | 11/1937 | Halpine . |
| 2,136,014 | 11/1938 | McDonald . |
| 2,472,939 | 6/1949 | Connolly . |
| 2,649,069 | 8/1953 | Halpine . |
| 2,833,240 | 5/1958 | Semolic . |
| 2,870,733 | 1/1959 | Winther . |
| 2,876,729 | 3/1959 | Georgette . |
| 3,112,726 | 12/1963 | Paul ..... 114/218 |
| 3,126,858 | 3/1964 | Rosinski . |
| 3,190,253 | 6/1965 | Grimm . |
| 3,334,914 | 8/1967 | Vierregger . |
| 3,344,264 | 9/1967 | Perkins . |
| 3,398,922 | 8/1968 | Martin . |
| 3,747,554 | 7/1973 | Allen . |
| 4,270,478 | 6/1981 | Kafka et al. . |
| 4,344,378 | 8/1982 | Martin . |
| 4,685,500 | 8/1987 | Silvia . |
| 5,477,800 | 12/1995 | Lawrence . |
| 5,477,801 | 12/1995 | Lawrence . |

*Primary Examiner*—Jesus D. Sotelo

*Attorney, Agent, or Firm*—Christensen O'Connor Johnson & Kindness, PLLC

[57] ABSTRACT

A cleating device (20) for securing a line (34) to a boat or a dock. The device (20) includes a cleat head (36) supported by two upright stems (38) connecting to an elongated platform (30) having opposed ends and a middle section therebetween. A deadeye (28) is formed between the cleat head stems (38). The cleat head (36) includes at least two protruding arms (37*a*), (37*b*). In one embodiment, the cleat head protruding arms (37*a*), (37*b*) form a V-shape. In a second embodiment, the cleat head protruding arms (37*a*), (37*b*) form an S-shape. Chock side horns (26*a*), (26*b*) are provided at the platform ends and are each generally oriented inward, toward the platform middle section. The protruding arms (37*a*), (37*b*) and side horns (26*a*), (26*b*) are nonlinearly aligned relative to one another as viewed in plan view.

24 Claims, 10 Drawing Sheets

CLEATING DEVICE

FIELD OF THE INVENTION

The present invention relates to hardware for securing lines thereto; and more particularly, to combination chock and cleat hardware used on water vessels, docks, trucks, and other vehicles and structures to secure, guide, control, and connect lines.

BACKGROUND OF THE INVENTION

Cleats are fitting used to secure lines. The majority of cleats currently used have two horns protruding in opposite linear directions from a central stem. A rope or line is knotted to the horns and is typically guided by a distant chock. Chocks are fittings through which lines are led. Fairleads are fittings that change the direction of a line. Deadeyes are holes through which a line may be passed. Previously, most cleats, chocks, fairleads, and deadeyes have been employed separately, resulting in redundancy of fittings, additional boat weight, added cost, and increased probability of tangling a line or of tripping a crewman.

There are known devices formed as combinations of cleat, chocks, and deadeye. For example, U.S. Pat. No. 5,477,800 describes a device having a combined cleat and chock. The cleat includes two horizontally protruding horns that extend in opposite linear directions. Each horn has a curved inner surface for use in guiding the line. Facing each protruding horn in an aligned manner is a chock side horn that also has a curved inner surface. The side horns appear to allow a person to guide the line from either direction without having to remove the line from the device. All four of the horns of Lawrence are coaxially aligned. The outer upper surfaces on the side ends are sloped to help deflect a foot that is moving parallel to the device.

U.S. Pat. No. 5,477,801 describes a device that is similar to the above '800 patent device, except the components are not integrally formed as a single unit. This results in the '801 device having potentially less structural integrity than the '800 device and more expensive to attach.

U.S. Pat. No. 3,747,554, issued to Allen, discloses a combination chock 16 (formed as a cleat) and fairlead fitting 18 for boats and the like. The chock base and head portions are recessed in the entrance of an upwardly-open well at a corner in the top portion of a deck member. A passage forms a fairlead in a side surface of the deck member. The fairlead passage extends directly into the well at a level beneath the chock.

The above devices as well as others suffer from various disadvantages. In particular, none of the devices are particularly useful in redirecting a line in other than a direction normal to the cleat. Even in the case of the Lawrence patents '800 and '801, a line that is directed in a non-normal manner will undesirably rub against the side horn inner surfaces where the line-to-surface contact area is relatively small. Over time, the line will fray and break more easily.

Another disadvantage of known devices is their inability to encourage a chocked line to stay therewithin. It is very important to ensure that the line does not come out of its location. The horizontally-aligned horns of the '800 and '801 devices can again be unsatisfactory because they do not offer an efficient resistance to the line lifting out. In some cases, it can be desirable to have a device that could avoid initially catching lines (and toes) that are not actually meant to enter the device. The '800 and '801 do not appear to provide this feature either, since their configurations would tend to indiscriminately catch any line or object that passes over them.

These disadvantages limit the types of line securing circumstances for which prior combination devices are useful. Thus, a need exists for a device that combines a cleat, chock, fairlead and deadeye in which the fairleads will guide the line in a non-normal manner without causing unnecessary stress on the line that might make it fray or snap. The ideal device would additionally be formed for use in specific cleating applications so that the user could quickly attach the line and/or readily secure the line without fear of the line undoing or letting slip. The device would also offer a means of preventing any unwanted lines from snagging at the device location while keeping assigned lines in place. The present invention is directed to fulfilling this need.

SUMMARY OF THE INVENTION

In accordance with aspects of the present invention, a cleating device including an elongated platform supporting a cleat head and chock is provided. The platform includes opposed ends and a middle section therebetween. The cleat head is connected to the platform at the middle section via a pair of upright stems between which a deadeye opening is formed and through which a line may be passed. The cleat head includes two protruding arms. In addition, the device includes at least one side horn connected to one end of the platform. Preferably two side horns are provided, with one side horn being connected to each platform end and the cleat head being located between the side horns. Each horn extends toward the middle section. At least one side horn overlaps its respective protruding arm in plan view. The protruding arms are nonlinearly aligned with respect to any of the side horns in plan view.

In accordance with other aspects of this invention, the device attaches to a generally planar attachment surface. Alternatively, the device may be adapted to be partially or entirely embeddable in a stepped or recessed attachment surface.

In accordance with still other aspects of this invention, the protruding arms are positioned relative to one another in a nonlinearly-aligned manner in plan view. In a first embodiment of the cleating device, the cleat head protruding arms form a V-shape in plan view. In a second embodiment of the cleat device, the cleat head protruding arms form an S-shape in plan view.

In accordance with further aspects of this invention, each side horns includes a fairlead undersurface for guiding the line in a particular direction. In one embodiment, the fairlead guides a line in a direction generally transverse to its side horn's respective protruding arm. Each side horn preferably includes a beveled upper inner surface for encouraging the line to enter the device. The side horns and the cleat head preferably have substantially coplanar horizontal lower inner surfaces.

In accordance with still further aspects of this invention, an alternative embodiment is provided in which the cleat head protruding arms are linearly aligned in plan view. Each side horn is formed as a pair of tines. The protruding arms extend into the space formed between the tines of their respective side horn.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1A:
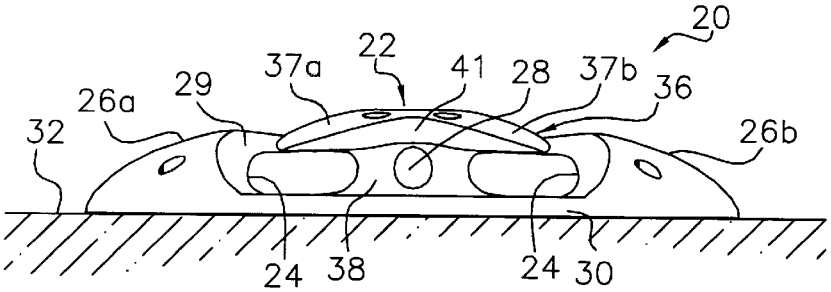
FIGS. 1A–1C are an inboard side elevation view, a topdown plan view, and an outboard side elevation view of a first embodiment of a cleating device formed in accordance with the present invention.

Referring generally to FIGS. 1–13, the present invention is an improved cleating device 20 that is formed as a combination of cleat 22, fairlead 24, chock 26, and deadeye 28, all in one. As used herein, cleats 22 are fittings for securing lines. Fairleads 24 are fitting surfaces that change the direction of a line. Chocks 26 are fittings through which lines are led or held. Deadeyes 28 are holes or openings through which lines may be passed. These components are integrally formed as a single unit attachable to a structure or surface 32 (or, as in FIG. 8, to a line 32') using any one of a number of conventional attachment methods, e.g., screws, bolts, rivets, adhesive, welds, etc. The present invention may also be used in applications other than for marine cleating, e.g., truck beds, airplane tie downs, window blind ties, etc.

Referring to FIG. 1A, the cleating device 20 includes an elongated ovoid platform 30 having an outer surface. The cleat 22 includes a cleat head 36 supported above the platform 30 via a pair of cleat stems 38 that extend outwardly from a middle region of the platform outer surface. The cleat head 36 preferably has a nonlinear shape in plan view. See FIG. 1B. The cleat head 36 includes a pair of protruding arms 37*a,* 37*b* that extend laterally outward from a connecting member 41. Plane A is drawn in a number of the plan views for purposes of the discussion below regarding the protruding arms and the chock. The cleating device 20 has at least one protruding arm on each side of plane A.

The space bounded by the cleat stems 38, the connecting member 41, and the platform 30 defines the deadeye 28. During use, the line may be threaded through the deadeye 28 and tied back onto itself, or simply tied in order to function as a knot stop. See, for example, the line arrangements of FIGS. 13E–13G. The line is labeled number 34. The deadeye surfaces are smooth and curved.

Referring back to FIG. 1A, the cleating device 20 further includes chock side horns 26*a,* 26*b* formed at each end of the platform 30. The horns are positioned to extend generally inward, i.e., to regions within the bounds of the platform as illustrated in plan view. Each side horn 26*a,* 26*b* operates in conjunction with its respective protruding arm 37*a,* 37*b* to maintain the line in the device 20. Portions of the interior undersurface of each of horn 26*a,* 26*b* function as fairleads 24 to guide the line in a certain direction and to prevent line chaffing at the horns 26*a,* 26*b*.

The cleat head 36 has two general embodiments. In the first embodiment, the protruding arms 37*a,* 37*b* are shaped as mirror images of each other relative to plane A. Preferably, the cleating head forms a V-shape in plan view. Variations of this form are shown in FIGS. 1, 3, 4, 9, 12, 13A, 13B, and 13E–13G. In the second embodiment, the protruding arms 37*a,* 37*b* are shaped as like images of the each other relative to plane A. Preferably, the cleat head is formed in an S-shape. Variations of this form are shown in FIGS. 2, 5, 6, 8, 10, 11, 13C, and 13D. In addition to and within these embodiments, there are a number of useful variations that may exist for cleating devices formed in accordance with the present invention.

FIGS. 1A–1H illustrate one arrangement of the first embodiment of a cleating device 20 formed in accordance with the present invention. The platform 30 is shaped as a circular segment such that one longitudinal side edge (i.e., the inboard edge) is generally straight and the opposite longitudinal side edge (i.e., the outboard edge) is generally arcuate. The cleat head 36 is V-shaped and oriented to open toward the arcuate longitudinal edge. The cleat stems 38 are located in a generally longitudinal manner and are positioned slightly closer to the straight longitudinal side edge than to the arcuate side edge.

One protruding arm 37*a* is positioned from plane A by an angle, $\alpha$. The angle $\alpha$ ranges from about 40 degrees to about 80 degrees, the preferred angle being about 65 degrees. Illustrations of these various angles are shown in FIG. 12. The angle $\alpha$ affects the lateral width of the device and should therefore be appropriate for the space available. The other protruding arm 37*b* extends a similar angle from plane A, though in an opposite angular direction. Therefore, the protruding arms 37*a* and 37*b* are mirror images of one another as viewed from plane A. FIG. 13 illustrates example line wraps that may be formed. Preferably, the line 34 is secured to the cleat 22 and/or the deadeye 28 and extends away from the device 20 along the platform straight side edge. In this position, a simple one-half twist with the tailing side of the line laid below the twist on the inboard side of cleat is sufficient to bite the line and hold it securely. See particularly FIG. 13B.

Referring back to FIG. 1B, the adjacent side horns 37*a,* 37*b* extend inward from the platform ends an amount sufficient to overlap their respective protruding arms in plan view by a distance $\Lambda$. In the embodiment of FIG. 1, the side horns are positioned laterally adjacent to their respective protruding arm to produce this overlap distance. Therefore, neither side horn 26*a,* 26*b* is coaxially aligned with either protruding arm 37*a,* 37*b* of the cleat head 36. It is preferred that the edges of each protruding arm that are facing the side horns be substantially parallel with their respective side horn edges, with a distance D therebetween just sufficient to pass the line. Therefore, each arm and side horn pair form a diagonal passage 25 for the line to enter the device 20. The passage works with the fairlead to keep a line engaged with the device.

Figure 1B:
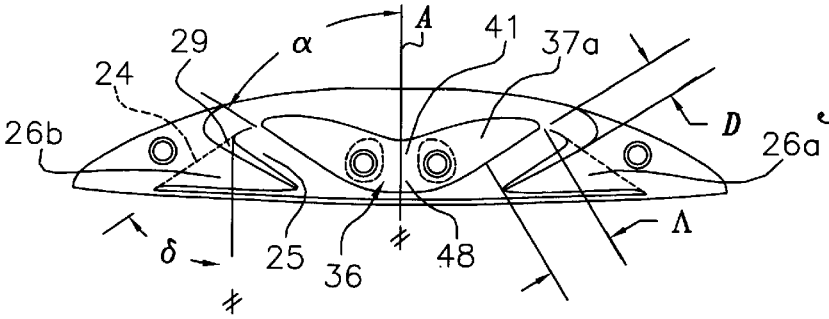
Figure 1C:
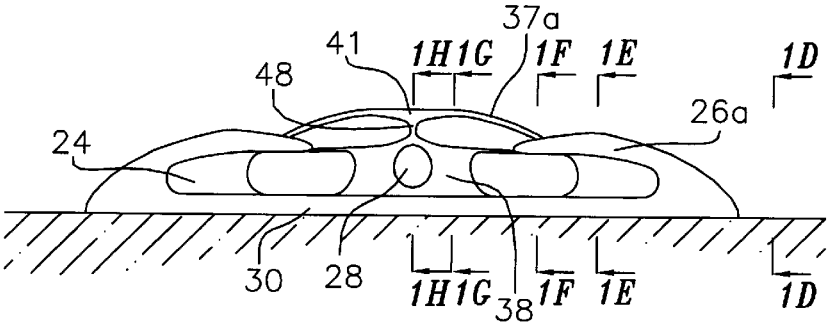
Figure 1D:
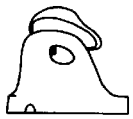
FIGS. 1D–1H are a series of cross-sectional end views taken along the various lines indicated in FIG. 1C.
Figure 1E:
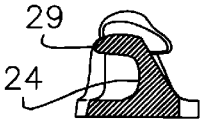
Figure 1F:
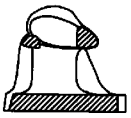
Figure 1G:
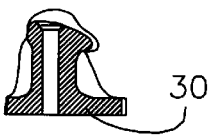
Figure 1H:
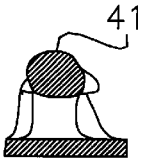
Figure 4A:
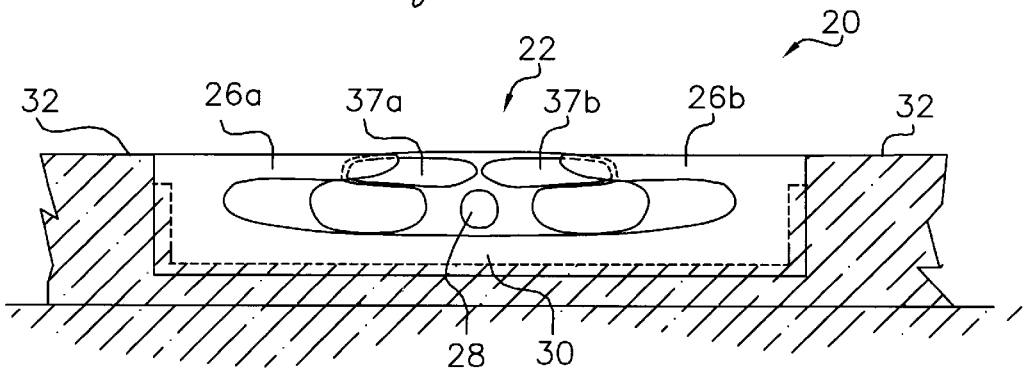
FIGS. 4A and 4B are outboard side elevation and topdown plan views of a fourth embodiment of a cleating device formed in accordance with the present invention.

As will be appreciated from viewing FIG. 1C, the upper surfaces of the side horns 26*a,* 26*b* may be angled inward or may be kept flush with the device profile as shown in the embodiment of FIG. 4A. Referring particularly to FIG. 1B, in most embodiments, the side horns upper surfaces are preferably beveled along their edges (labeled 29 in FIG. 1B) to encourage the line to funnel into the device 20 and slip around the cleat 22 and/or under the side horns 26*a,* 26*b*. Because the passage 25 is angled relative to the fairleads, any line that slips into the passage will turn to fit the cleat and/or fairlead and will therefore likely remain engaged with the device during use. As shown in FIG. 1B, the passage 25 is optimally about perpendicular to the fairlead 24.

Although not readily apparent from viewing FIG. 1B, the outboard end of the diagonal passage (i.e., that end nearest the arcuate side) is preferably slightly larger than the inboard end. For lines sized similar to the smaller end, the device encourages retention of the line at the device 20. Once the line has entered the device, random lifting and release of the line is discouraged by including generally flat horizontal horn inner surfaces lying substantially parallel to the plane of the platform outer surface and side horns having a bottom surface located at the same upright height as the deadeye 28 height.

As shown in FIG. 1B, the fairleads 24 of the first embodiment cleating device are angled outward an amount δ relative to plane A. The wider the angle δ, the greater the range of directions the fairleads 24 will smoothly guide the line. The amount δ is preferably in the range of about 80 degrees to 40 degrees as measured from plane A. Illustrations of these various angles are shown in FIG. 12. Should the device be intended for use with a line that extends from the arcuate platform longitudinal side edge, the side horns and fairleads 24 should be re-oriented accordingly.

The first embodiment of FIG. 1 is useful on open boat surfaces where snags happen more frequently. The first embodiment is also helpful in mooring or other instances in which potentially large fairlead angles may be required. During use, the line preferably extends from the straight side of the device in order to take advantage of the wide fairlead angles δ. As will be appreciated by those with skill in the art, there are a number of line ties that may be made with a cleating device of the first embodiment that provide a self-perpetuating, secured configuration. See, for example, FIGS. 13A, 13B, and 13E–13G.

Figure 2A:
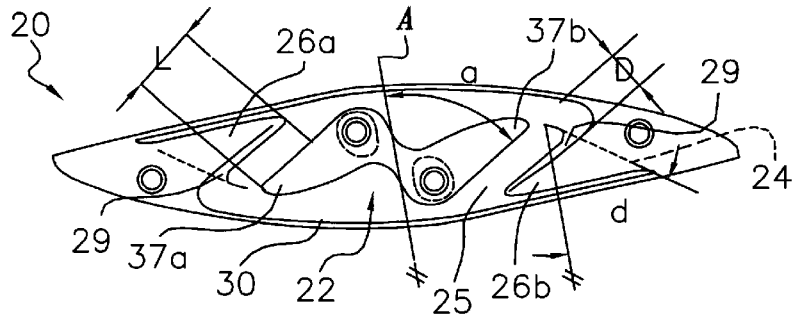
FIGS. 2A and 2B are topdown plan and side elevation views of a second embodiment of a cleating device formed in accordance with the present invention.

Referring to FIGS. 2A–2G, a second embodiment of the present invention is provided in which the cleat head 36 has an S-shape. Thus, both protruding arms 37*a,* 37*b* of FIG. 2A are positioned from plane A (in like angular directions) by the angle, α. Therefore, the protruding arms 37*a* and 37*b* are like images of one another as viewed from plane A. In comparing the second embodiment to the first embodiment, the two are substantially similar except one half of the device in plan view is "upside down". Stated differently, the plan view of the second embodiment may be obtained by dividing a plan view of the first embodiment device into two portions about plane A, inverting one of the portions, and reconfiguring the cleat head connecting member 41 appropriately. As with the first embodiment, neither protruding arm is coaxially aligned with its respective side horn, but instead is adjacent to its respective horn.

During use, the line 34 is secured to the cleat 22 and/or the deadeye 28 and extends away from the device 20 along either side, though preferably at a fairlead 24. As shown best in FIG. 2B, the fairleads 24 of the second embodiment cleating device are angled outward in opposite directions by an amount δ relative to a plane A. Use and design of the second embodiment should be carefully planned, so that the intended direction of line travel will be congruent with the orientation of the fairleads 24 to avoid unwanted chaffing of the line.

The second embodiment of FIG. 2 is generally useful on boat surface open decks and other places where snags could happen. The second embodiment is particularly useful for masts, booms, halyards, and cockpits for sheet lines. A number of line ties may be formed with a cleating device of the second embodiment that are similar to the ties available with a device formed in accordance with the first embodiment. This embodiment is used specifically for masts or booms for halyards and cockpit bow sheet. A relative angle of about 180° between fairleads has been shown to work best for sheet and halyard applications.

In addition to the first and second embodiments described above, there are numerous shape and orientation variations that may be incorporated. FIGS. 3–11 attempt to illuminate some of the more useful configurations.

Figure 2B:
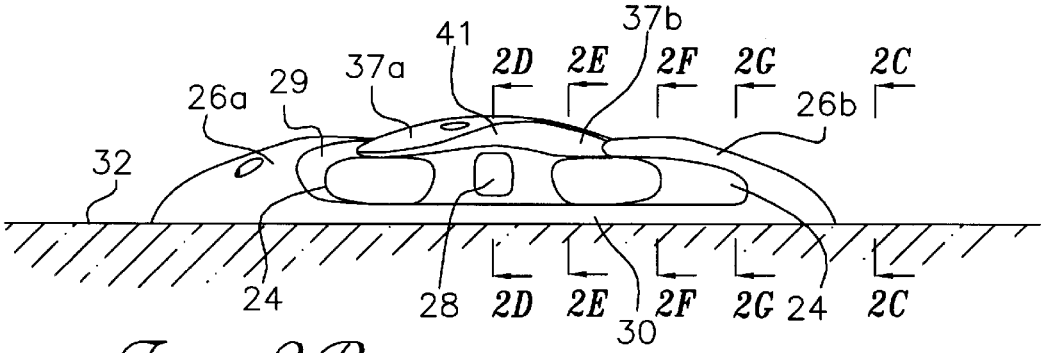
Figure 2C:
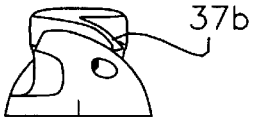
FIGS. 2C–2G are a series of cross-sectional end views taken along the various lines indicated in FIG. 2B.
Figure 2D:
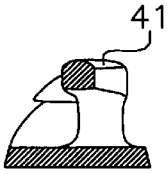
Figure 2E:
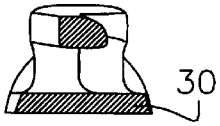
Figure 2F:
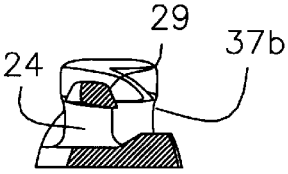
Figure 2G:
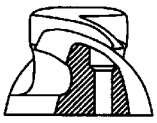
Figure 3A:
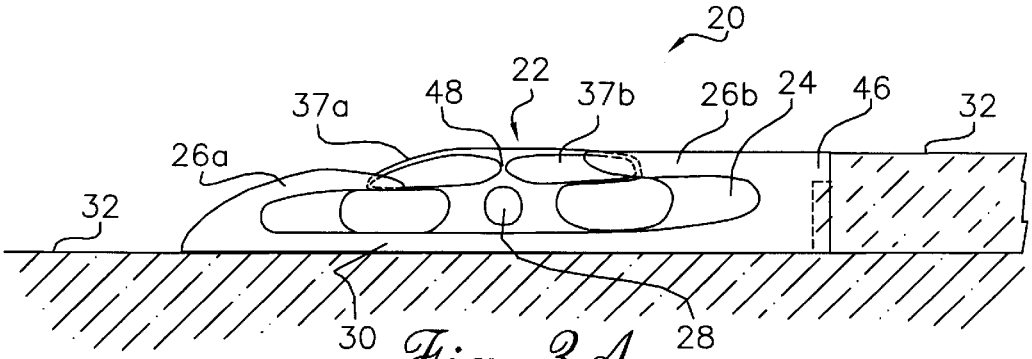
FIGS. 3A and 3B are outboard side elevation and topdown plan views of a third embodiment of a cleating device formed in accordance with the present invention.
Figure 3B:
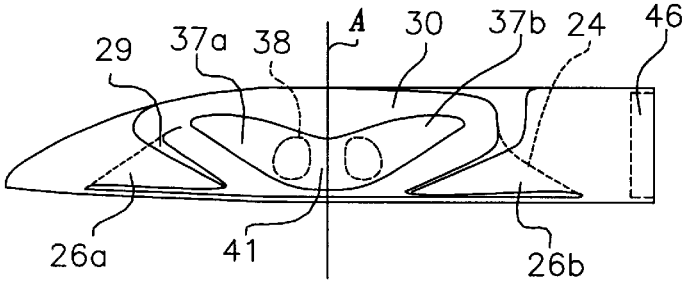
Figure 4B:
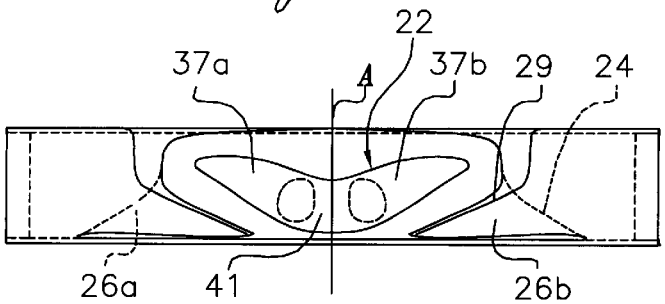

The embodiments shown in FIGS. 1C and 2B have a subtle convex curve to their upper surfaces when studied from a longitudinal elevation side view. This curve minimizes line snagging and tripping by the crew. FIGS. 3 and 4 illustrate a variation in which one or both of the devise ends is thicker or raised so that it may be positioned adjacent a step or recess in the attachment surface 32. The outer upper surface of the side horn at the raised end is preferably sized to be flush with the adjacent step attachment surface 32. The thicker end edges may include a lip 46 that can be used to attach the device 20 to the surface 32. Alternatively, the device may be attached to the structure beneath the device 20 as described in the first and second embodiments. These embedded or partially-embedded embodiments are modified to attach to bullworks, gunnels, handrails, or combings. They are helpful in mooring and also as fender attachments.

The embodiments shown in FIGS. 5–8 illustrate further variations that are possible, including changes to the platform shape, movement of the cleat stems 38 to various locations on the platform, reshaping of the side horns, and reshaping of the fairleads 24. The embodiment of FIGS. 5A and 5B is particularly useful for cleating sheet lines at locations downline of sheet winches. The embodiment of FIGS. 6A and 6B is particularly useful for cleating halyards or haul lines at locations on a mast downline of halyard winches or mast shives, at locations on a boom downline of down haul equipment, or at any location where snags or sail chafing is possible. A purchase lock 39 is a useful design element to include in these configurations for applying the final pull to halyards. Each fairlead 24 of either embodiment is shaped to allow a line 34 to easily wrap at least 180 degrees around its side horn or enter the device 20 from the fairlead 24 before contacting the cleat 22. The lower side horn of either embodiment can be used as an additional anchoring mechanism or can be used to hang the line 34 in a manner as to keep it from becoming tangled with other lines.

Figure 5A:
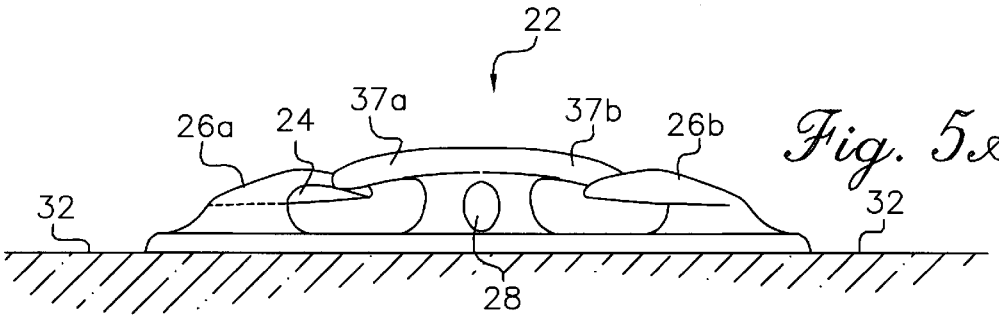
FIGS. 5A and 5B are side elevation and topdown plan views of a fifth embodiment of a cleating device formed in accordance with the present invention.
Figure 5B:
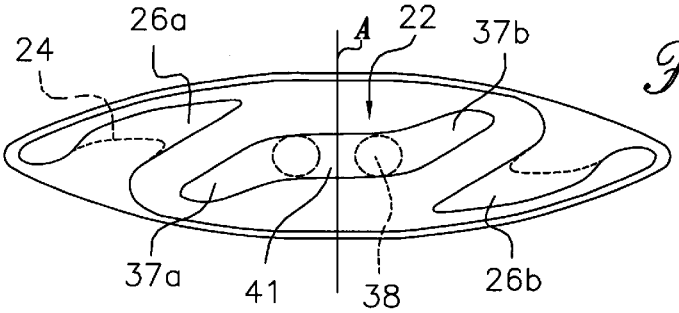
Figure 6A:
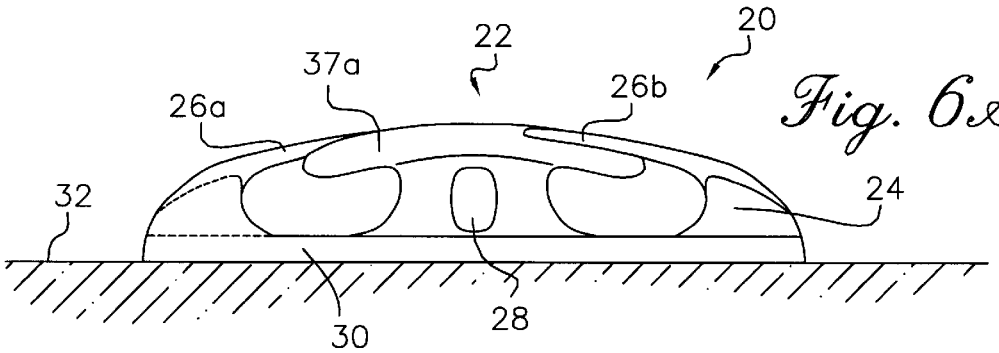
FIGS. 6A and 6B are side elevation and topdown plan views of a sixth embodiment of a cleating device formed in accordance with the present invention.
Figure 6B:
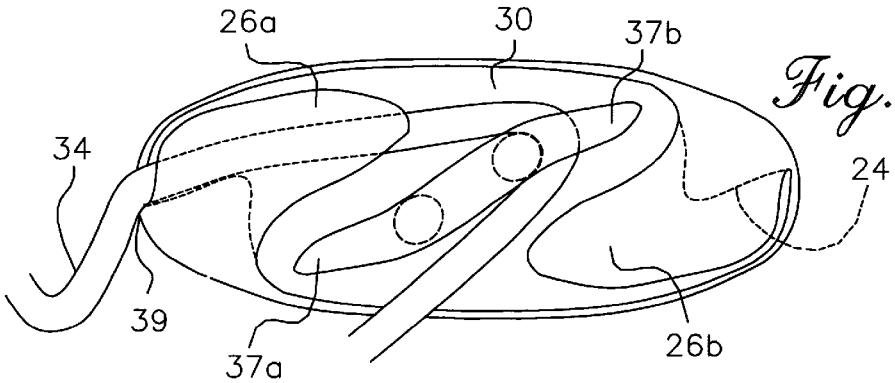

Another variation may be presented in the shape of the connecting member 41. The member 41 is substantially linear as shown in FIG. 5B. Alternatively, the connecting member 41 may include an angular side extension 48 as shown in FIG. 1B.

Figure 7A:
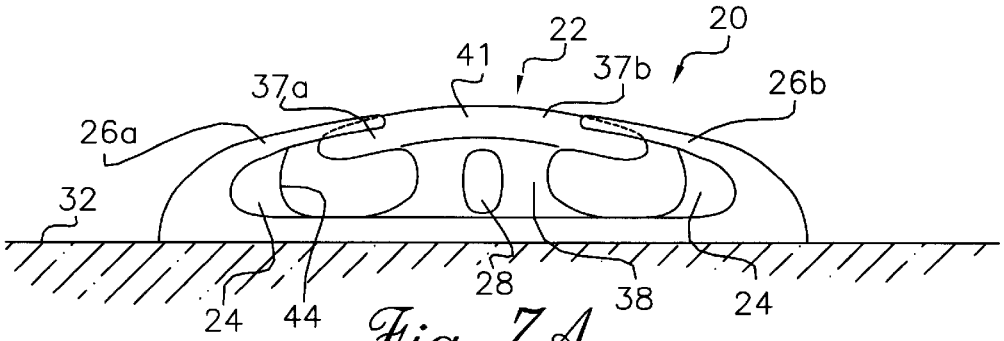
FIGS. 7A and 7B are side elevation and topdown plan views of a seventh embodiment of a cleating device formed in accordance with the present invention.
Figure 7B:
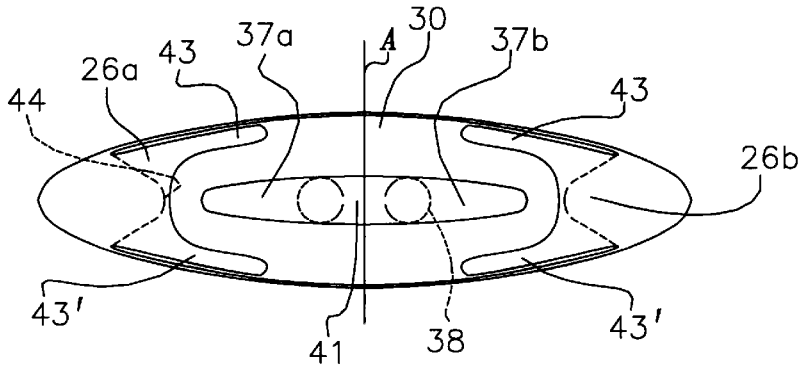

The embodiment shown in FIGS. 7A and 7B illustrate further variations that are possible with a cleating device formed in accordance with the present invention. In this embodiment, the entire cleat head 36 is linearly formed in plan view, and the side horns 26*a,* 26*b* are forked and positioned so that their tines 43, 43' are placed on opposite sides of their respective protruding arm. As in the first embodiment, portions of the side horns overlap their respective protruding arms. In this embodiment, the tine ends overlap the arms. Neither protruding arm 37*a,* 37*b* is coaxially aligned with any of the side horn tines 43, 43', though, both are substantially parallel with their adjacent tines and each other.

This embodiment is particularly useful for foredeck applications where fairleads are required from all four quadrants (e.g., a small boat mooring cleat.) Because the line may lead onto and extend from the cleat head 36 from either longitudinal side, the fairleads 24 of FIG. 7 are preferably angled outward along both sides. A curved ridge 44 is formed by the fairleads changing direction between longitudinal sides.

Figure 8A:
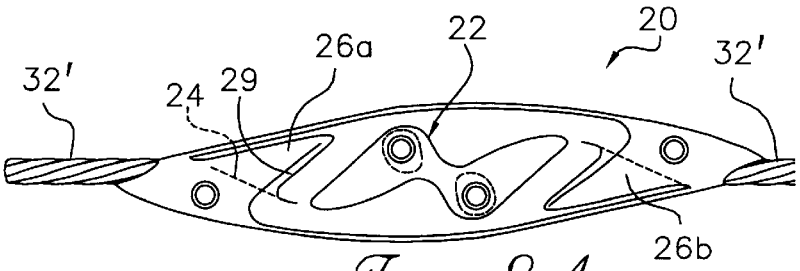
FIGS. 8A–8C are topdown plan, side elevation, and end views, respectively, of an eighth embodiment of a cleating device formed in accordance with the present invention.
Figure 8C:
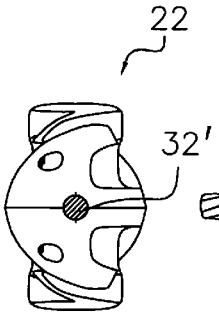
Figure 8B:
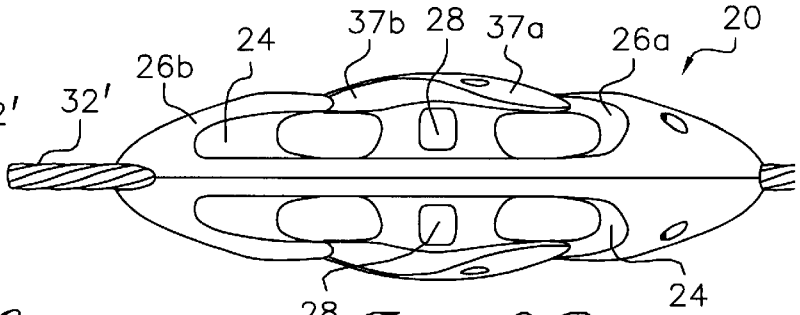
Figure 9A:
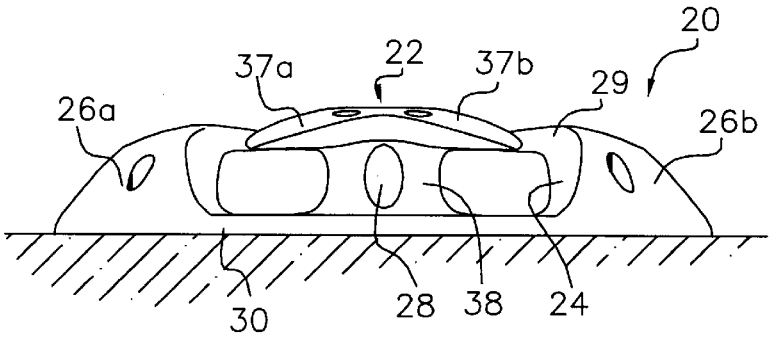
FIGS. 9A–12D are further variations possible in a cleating device formed in accordance with the present invention.
Figure 9B:
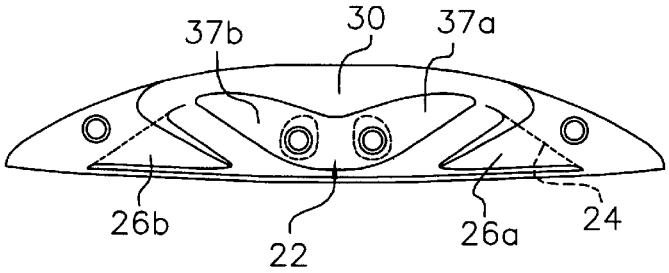
Figure 9C:
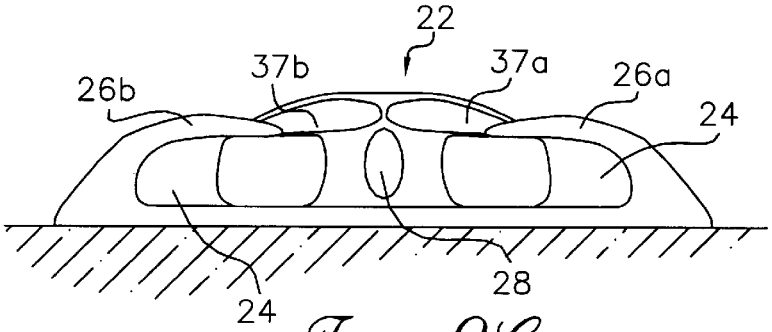
Figure 9D:
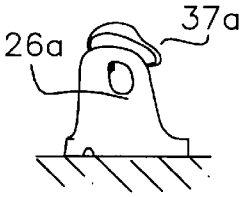

The embodiment shown in FIGS. 8A–8C illustrate further variations that are possible with a cleating device formed in accordance with the present invention. In this embodiment, two complete cleating devices have been joined back-to-back and a passageway has been formed down the longitudinal centerline of the combined device. This embodiment is particularly useful for cleating a line along a wire stay or any firm length of cable, e.g., a flag halyard, life lines, etc.

Figure 10A:
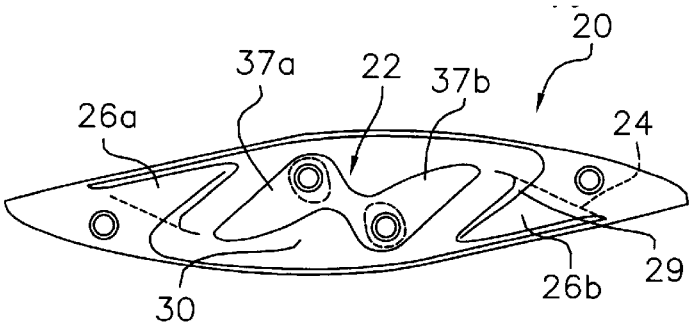
Figure 10B:
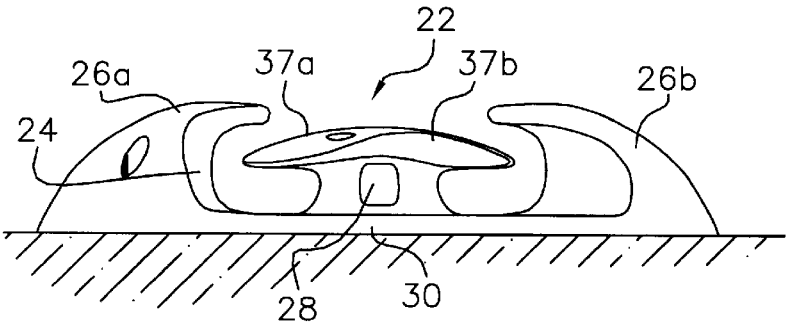
Figure 10C:
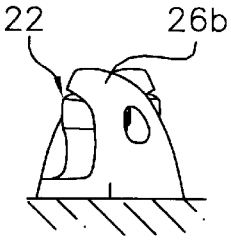
Figure 11A:
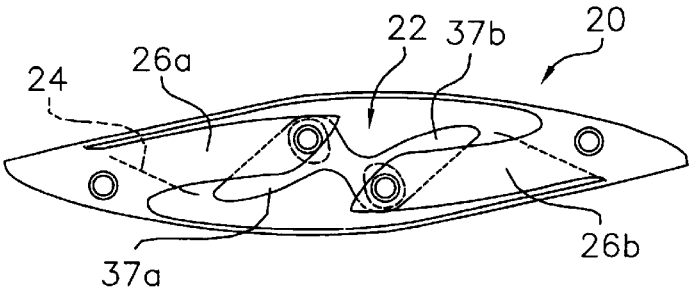
Figure 11B:
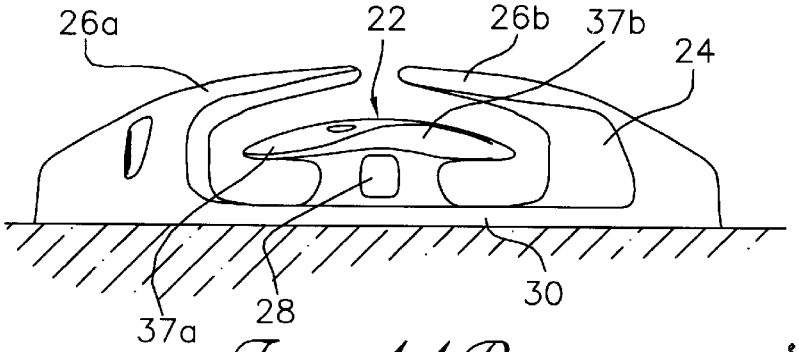
Figure 11C:
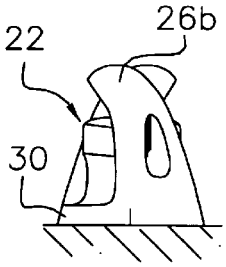
Figure 12A:
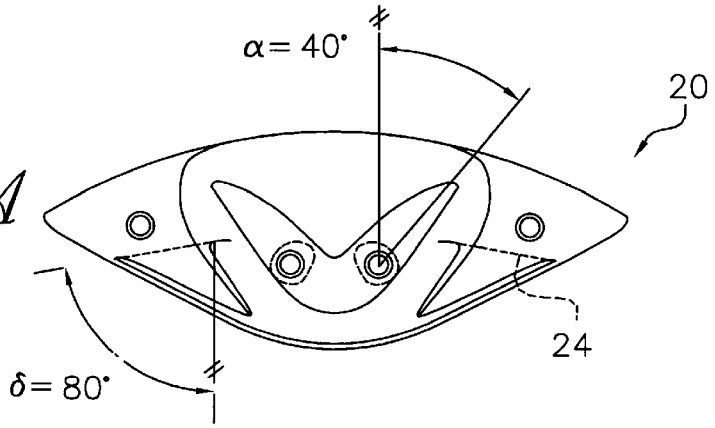
Figure 12B:
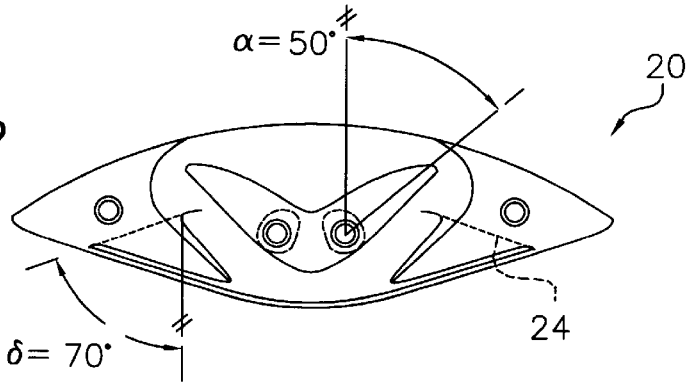
Figure 12C:
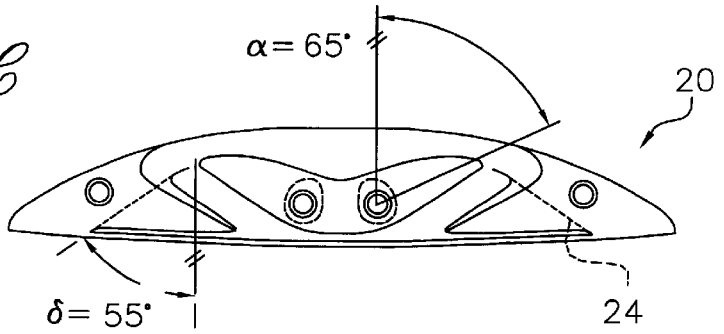
Figure 12D:
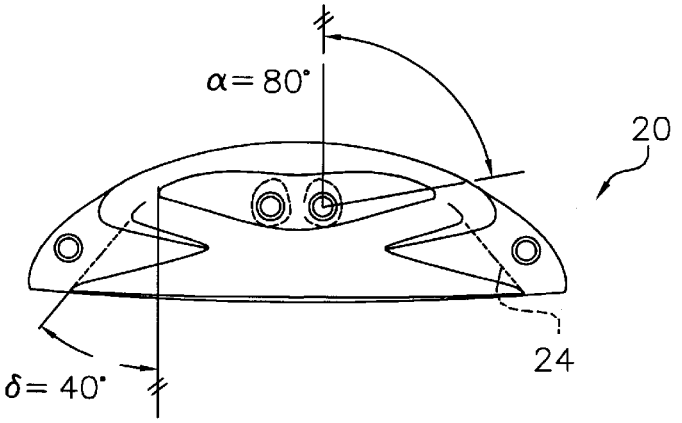
Figure 13A:
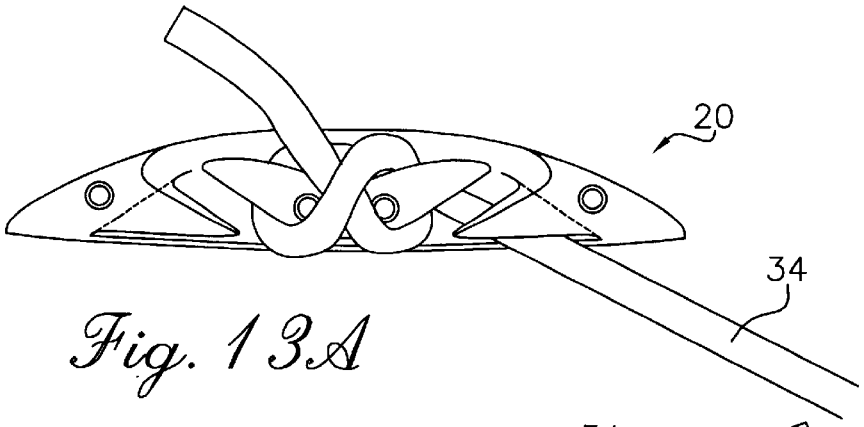
FIGS. 13A–13G are illustrations of example line wraps that may be formed with a cleating device formed in accordance with the present invention.
Figure 13B:
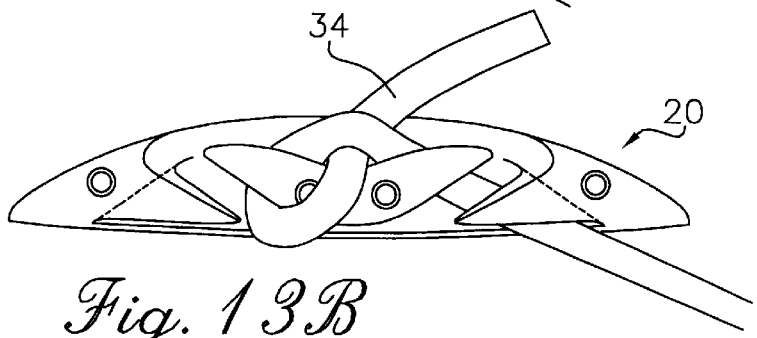
Figure 13C:
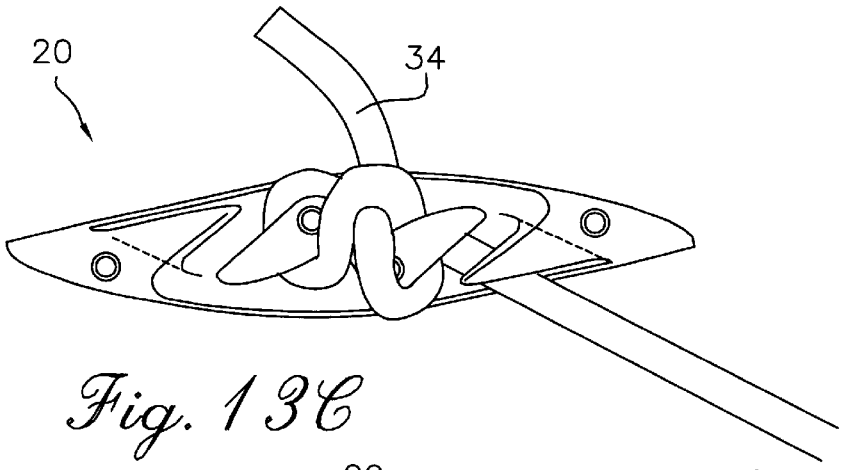
Figure 13D:
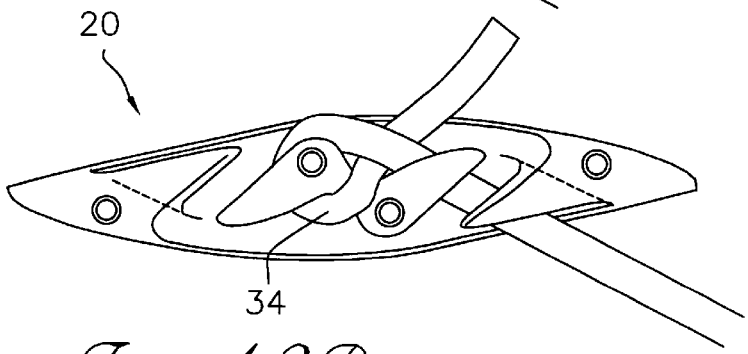
Figure 13E:
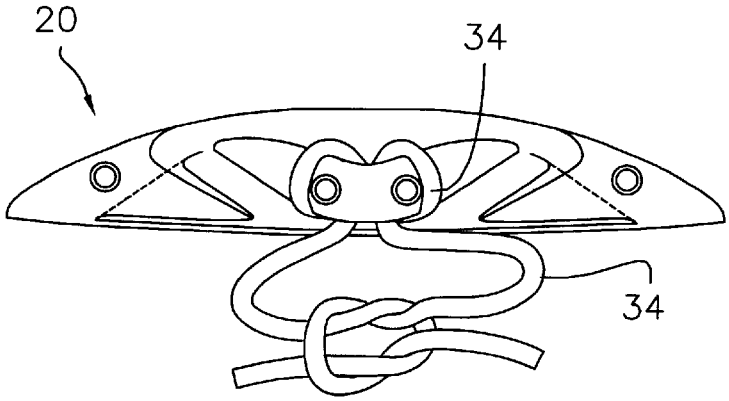
Figure 13F:
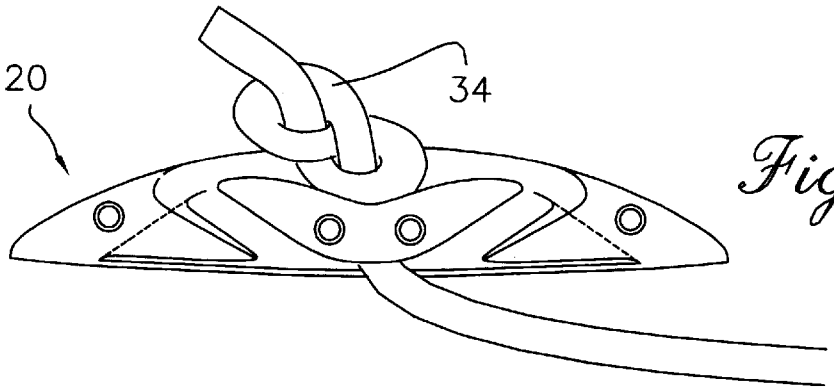
Figure 13G:
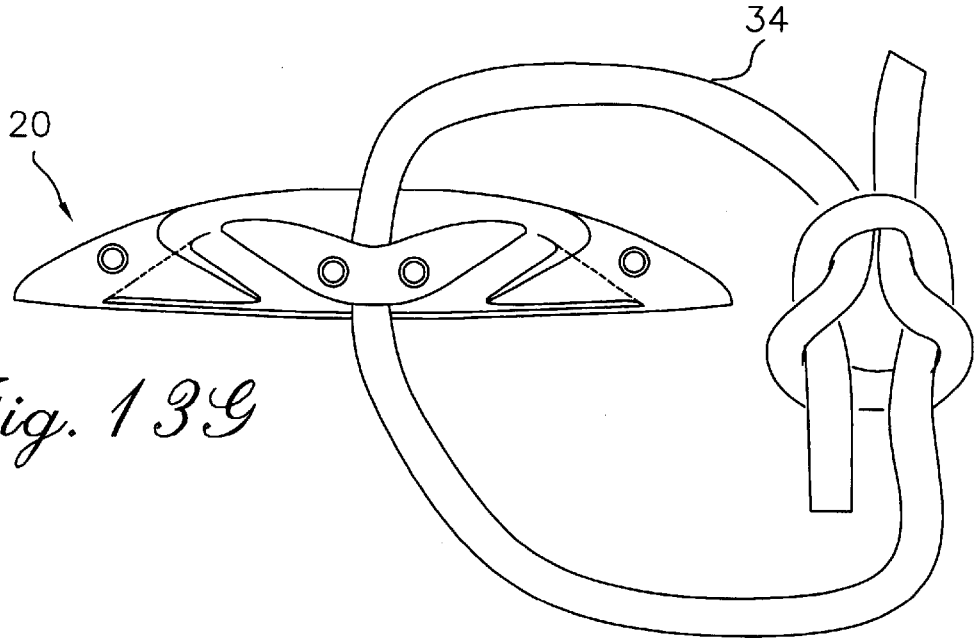

The embodiment shown in FIGS. 9A–9D illustrate a variation of the first embodiment in which the cleat 22 and side horns 26*a,* 26*b* are raised in height. This allows for multiple lines of design size to be attached to the cleat simultaneously. For the unusual instances in which it is desirable to catch a line on the cleating device (such as a line being thrown from the dock onto the bow), FIG. 10 illustrates variations of the second embodiment in which the side horns 26*a,* 26*b* are heightened to catch a line. Although not shown, either of the embodiments of FIGS. 9 or 10 may be configured with one side horn level with the cleat and the other side horn higher than the cleat. The embodiment of FIG. 11 includes both heightened side horns 26*a,* 26*b* that are additionally extended inward to overlap the cleat arms 37*a,* 37*b* in plan view. This arrangement has the additional feature of allowing only those lines of a particular size and smaller to even enter the cleating device.

As will be appreciated by those skilled in the art, a cleating device formed in accordance with the present invention has many advantages over prior art devices. The foil shape of the present invention device prevents other objects from snagging or ripping on the cleat head 36 and chock side horns. The various fairlead 24 orientations are particularly useful in redirecting a line without large amounts of chaffing. The shapes of the protruding arms and side horns encourage lines to enter and stay within the device.

While the preferred embodiments of the invention has been illustrated and described, it will be appreciated that various changes can be made therein without departing from the spirit and scope of the invention. It is suggested thus that in preparing a cleating device formed in accordance with the present invention, a designer should carefully consider the precise shape, orientation, and arrangement of all components according to the requirements of the particular application in which the device will be used.

The embodiments of the invention in which an exclusive property or privilege is claimed are defined as follows:

1. A cleating device for securing a line, the device comprising:

(a) an elongated platform having opposed ends and a middle section therebetween;

(b) at least one chock side horn connected to each platform end, each side horn extending toward the middle section;

(c) a cleat comprising a cleat head connected to the middle section of the platform, the cleat head having at least two protruding arms, wherein the at least one side horn includes portions positioned laterally adjacent to its respective protruding arm, a distance being formed therebetween capable of receiving the line.

2. The cleating device formed according to claim 1, wherein the at least one side horn overlaps its respective protruding arm by an amount of approximately 50% the length of the protruding arm.

3. The cleating device formed according to claim 1, wherein the platform is adapted to fit within a stepped attachment surface.

4. The cleating device formed according to claim 1, wherein the platform is connected to a generally linear attachment surface.

5. The cleating device formed according to claim 1, wherein the cleat head is connected to the platform via a pair of upright stems between which a deadeye opening is formed.

6. The cleating device formed according to claim 1, wherein the at least one side horn includes a fairlead undersurface, the fairlead for guiding the line in a particular direction.

7. The cleating device formed according to claim 6, wherein an open passage is formed between the at least one side horn and its respective protruding arm, the fairlead being oriented transverse to the open passage.

8. The cleating device formed according to claim 6, wherein an open passage is formed between the at least one side horn and its respective protruding arm, the at least one side horn being beveled along its upper edge at the passage.

9. The cleating device formed according to claim 1, wherein the cleat head forms a V-shape in plan view.

10. The cleating device formed according to claim 9, wherein each side horn has a fairlead undersurface oriented to guide a line in a direction generally transverse to the side horn's corresponding cleat protruding arm.

11. The cleating device formed according to claim 1, wherein the cleat head forms an S-shape in plan view.

12. The cleating device formed according to claim 11, wherein each side horn has a fairlead undersurface oriented to guide a line in a direction generally transverse to the side horn's corresponding cleat protruding arm.

13. The cleating device formed according to claim 1, wherein the at least two protruding arms are positioned relative to one another in a nonlinearly-aligned manner in plan view.

14. The cleating device formed according to claim 13, wherein the at least two protruding arms are substantially mirror images of one another as viewed in a plane transverse to the device longitudinal centerline.

15. A cleating device for securing a line, the device comprising:

(a) an elongated platform having opposed ends and a middle section therebetween;

(b) at least two side horns, at least one side horn being connected to each platform end and extending toward the middle section;

(c) a cleat comprising a cleat head connected to the middle section of the platform, the cleat head having at least two protruding arms nonlinearly aligned with respect to any of the at least two side horns in plan view.

16. The cleating device formed according to claim 15, wherein the side horns each include a fairlead undersurface oriented to guide a line in a direction generally transverse to the side horn's respective protruding arm.

17. The cleating device formed according to claim 15, wherein each side horn includes a beveled upper inner surface for encouraging the line to enter the device.

18. The cleating device formed according to claim 15, wherein the side horns and the cleat head each includes a substantially coplanar horizontal lower inner surface.

19. The cleating device formed according to claim 15, wherein the cleat head protruding arms are generally linearly aligned in plan view and wherein each side horn is forked having a pair of tines, each protruding arm extending into the space formed between its respective tines.

20. A cleating device for securing a line, the device comprising:

(a) an elongated platform having opposed ends and a middle section therebetween;

(b) at least one chock side horn connected to at least one platform end, the at least one chock side horn extending toward the middle section;

(c) a cleat comprising a cleat head connected to the middle section of the platform, the cleat head having two opposed protruding arms, wherein the at least one chock side horn includes portions positioned adjacent to one of the protruding arms, a distance being formed therebetween capable of receiving the line.

21. The cleating device formed according to claim 20, wherein the at least one chock side horn includes a fairlead undersurface, the fairlead for guiding the line in a particular direction.

22. The cleating device formed according to claim 21, wherein an open passage is formed between the at least one side horn and its respective protruding arm, the fairlead being oriented transverse to the open passage.

23. The cleating device formed according to claim 20, wherein the at least one chock side horn is beveled along an upper edge to encourage entry of a line.

24. The cleating device formed according to claim 20, wherein the two protruding arms are positioned relative to one another in a nonlinearly-aligned manner in plan view.

* * * * *